US011813846B2

(12) United States Patent
Murashima et al.

(10) Patent No.: US 11,813,846 B2
(45) Date of Patent: Nov. 14, 2023

(54) DRYING DEVICE WITH POSSIBILITY TO PREVENT CURLING OF PAPER AND IMAGE FORMING SYSTEM INCLUDING THE SAME

(71) Applicant: KYOCERA Document Solutions Inc., Osaka (JP)

(72) Inventors: Masaki Murashima, Osaka (JP); Tomoya Hotani, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 11 days.

(21) Appl. No.: 17/682,024

(22) Filed: Feb. 28, 2022

(65) Prior Publication Data

US 2022/0281237 A1 Sep. 8, 2022

(30) Foreign Application Priority Data

Mar. 3, 2021 (JP) ..... 2021-033613

(51) Int. Cl.
*B41J 11/00* (2006.01)

(52) U.S. Cl.
CPC ..... *B41J 11/0022* (2021.01); *B41J 11/0085* (2013.01)

(58) Field of Classification Search
CPC .... B41J 11/0022; B41J 11/0085; B41J 11/007
See application file for complete search history.

(56) References Cited

U.S. PATENT DOCUMENTS

2019/0283470 A1* 9/2019 Okayama ..... B41J 13/106

FOREIGN PATENT DOCUMENTS

JP 2009-285877 12/2009

* cited by examiner

*Primary Examiner* — Bradley W Thies
(74) *Attorney, Agent, or Firm* — LEX IP MEISTER, PLLC

(57) ABSTRACT

A drying device that dries a medium having an image formed thereon while conveying the medium, includes a conveyance belt having through holes formed in an entire surface thereof and supporting and conveying the medium in a predetermined conveyance direction, a heating section that applies warm air to the medium to dry the image and presses the medium onto the conveyance belt by the warm air, and a suction section that attracts the medium onto the conveyance belt by sucking air through the through holes. At least one of a force with which the heating section presses the sheet against the conveyance belt and a force with which the suction section attracts the medium to the conveyance belt is greater on a downstream side than on an upstream side in the conveyance direction.

6 Claims, 5 Drawing Sheets

DRYING DEVICE WITH POSSIBILITY TO PREVENT CURLING OF PAPER AND IMAGE FORMING SYSTEM INCLUDING THE SAME

INCORPORATION BY REFERENCE

This application is based upon and claims the benefit of priority from the corresponding Japanese Patent Application No. 2021-033613 filed on Mar. 3, 2021, the entire contents of which are incorporated herein by reference.

BACKGROUND

The present disclosure relates to a drying device for drying a recording medium on which an image is formed while conveying the recording medium, and an image forming system including the drying device.

An image forming system including an inkjet type image forming device is provided with a drying device for drying an image formed on a recording medium. A drying device is provided with a conveying means for conveying a recording medium, a dry air jetting means for jetting a dry air to the front side surface of the conveyed recording medium, and a negative pressure suction means for sucking the back surface of the recording medium.

SUMMARY

A drying device that dries a medium having an image formed thereon while conveying the medium includes a conveyance belt having through holes formed in an entire surface thereof and supporting and conveying the medium in a predetermined conveyance direction, a heating section that applies warm air to the medium to dry the image and presses the medium onto the conveyance belt by the warm air, and a suction section that attracts the medium onto the conveyance belt by sucking air through the through holes. At least one of a force with which the heating section presses the medium against the conveyance belt and a force with which the suction section attracts the medium to the conveyance belt is greater on a downstream side than on an upstream side in the conveyance direction.

DETAILED DESCRIPTION

Hereinafter, an image forming system and a drying device according to an embodiment of the present disclosure will be described with reference to the drawings.

Figure 1:
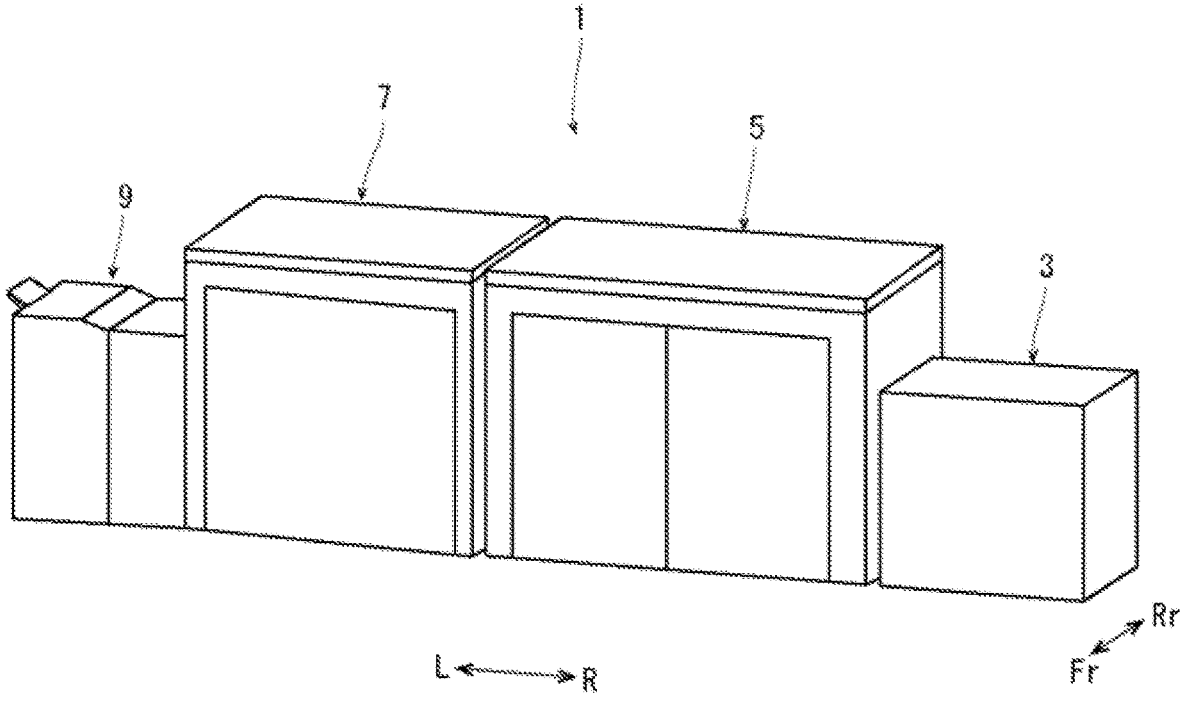
FIG. 1 is a perspective view schematically showing an image forming system according to an embodiment of the present disclosure.

First, an image forming system including a drying device will be described with reference to FIG. 1. FIG. 1 is a front view showing an image forming system. The signs L, R, Fr, Rr appropriately attached to each figure indicate the left side, the right side, the front side, and the rear side of the image forming system, respectively.

The image forming system 1 includes a paper feeding device 3, an image forming device 5, a drying device 7, and a post-processing device 9. The paper feeding device 3 accommodates paper and feeds the paper to the image forming device 5. The image forming device 5 is disposed on the left side of the paper feeding device 3, and forms an image on a sheet fed from the paper feeding device 3 by an inkjet system. The drying device 7 is disposed on the left side of the image forming device 5 and performs drying while conveying a sheet on which an image has been formed. The post-processing device 9 is disposed on the left side of the drying device 7, and performs post-processing on the paper dried by the drying device 7. The paper (or sheet) is an example of a recording medium.

Figure 2:
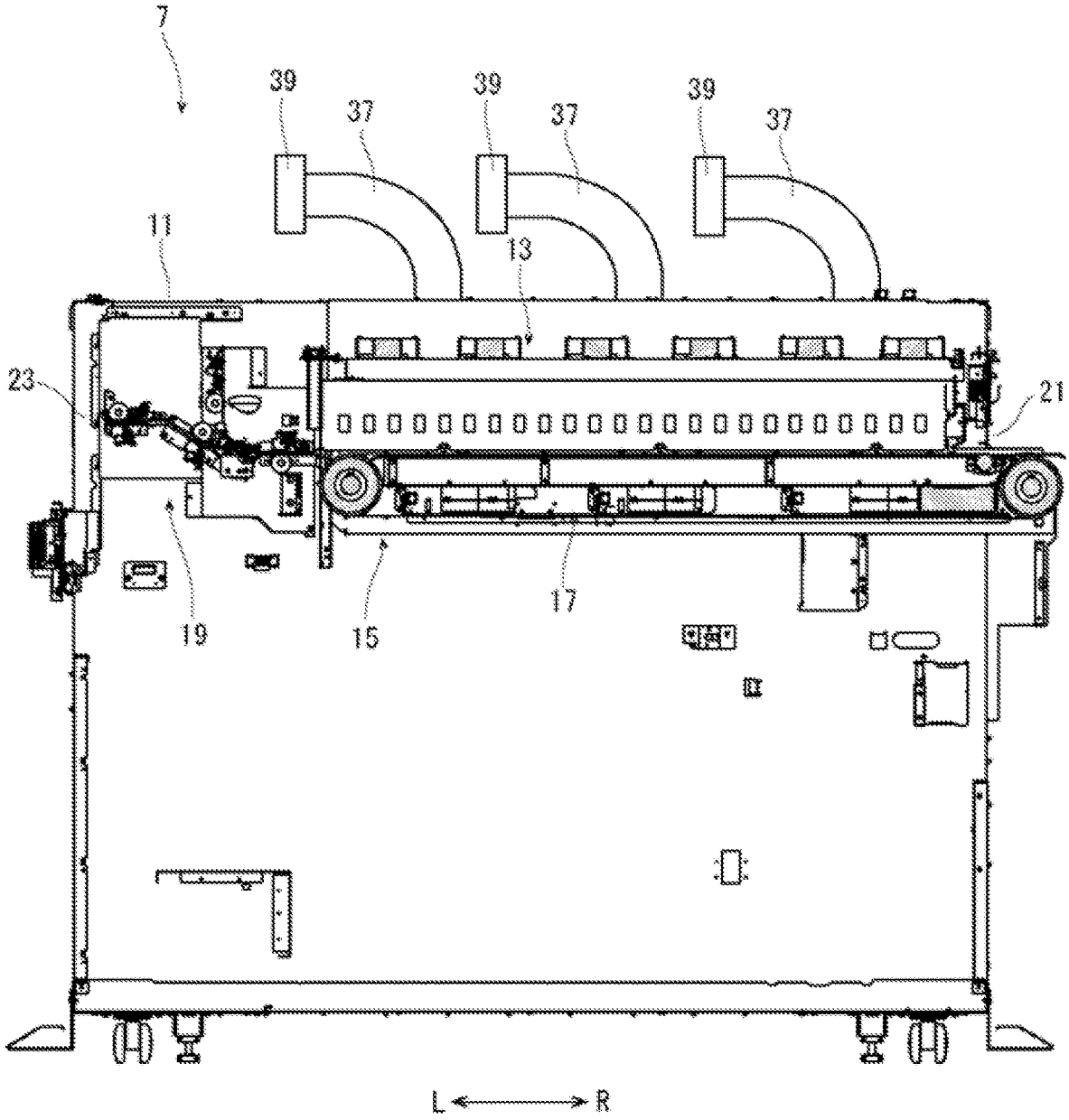
FIG. 2 is a front view showing the inside of the drying device according to the embodiment of the present disclosure.
Figure 3:
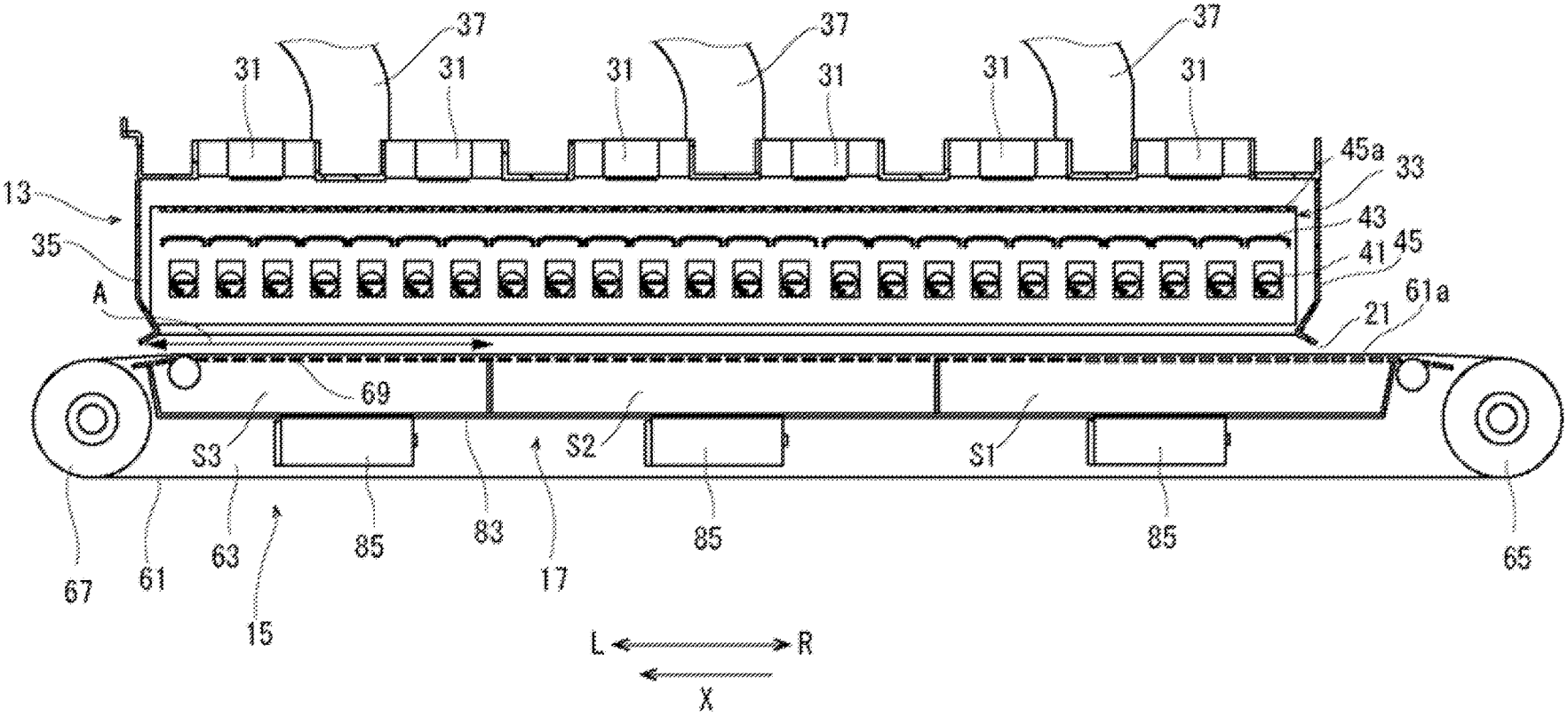
FIG. 3 is a front view showing the heating section, the conveying section, and the suction section of the drying device according to the embodiment of the present disclosure.
Figure 4:
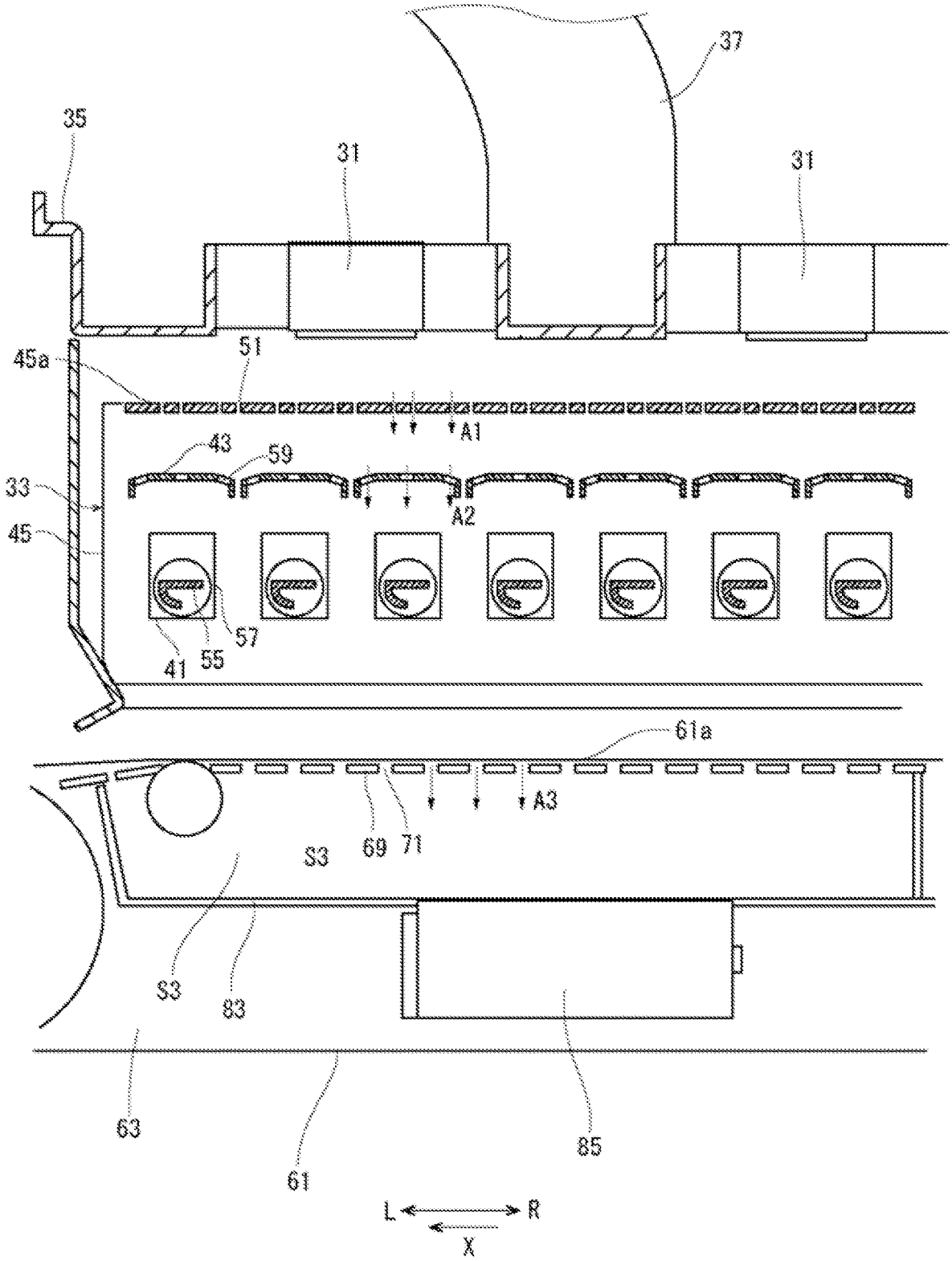
FIG. 4 is an enlarged front view showing part of a heating section, a conveying section, and a suction section of the drying device according to the embodiment of the present disclosure.
Figure 5:
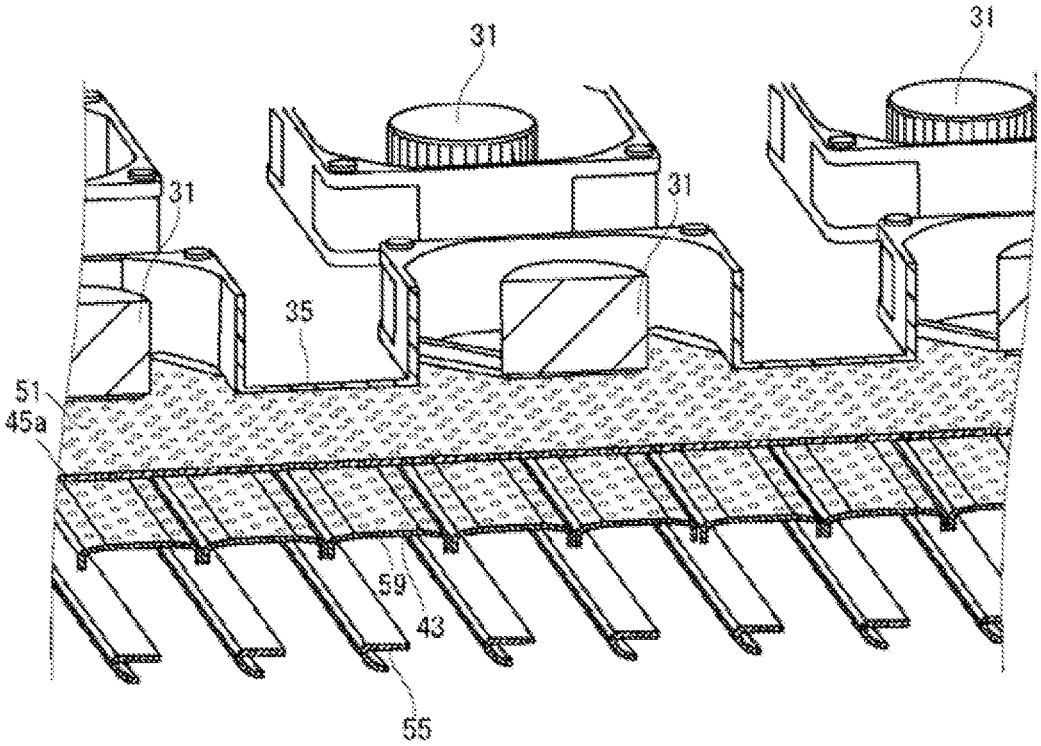
FIG. 5 is an enlarged perspective view showing part of the heating section, the conveying section, and the suction section of the drying device according to the embodiment of the present disclosure.

Next, the drying device 7 will be described with reference to FIGS. 2 to 5. FIG. 2 is a front view showing the inside of the drying device, FIGS. 3 and 4 are front views showing a heating section, a conveying section, and a suction section, and FIG. 5 is a perspective view showing the heating section, the conveying section, and the suction section.

As shown in FIG. 2, the drying device 7 includes a box-like casing 11. The housing (11) has a rectangular parallelepiped hollow section surrounded by a top plate, a bottom plate, front and rear side plates, and left and right side plates. The heating section 13, the conveying section 15, and the suction section 17 are accommodated in the hollow portion on the side (right side) of the image forming device 5. A cooling section 19 is housed above the hollow portion of the casing 11 on the side (left side) of the post-processing device 9.

A receiving port 21 through which a sheet (medium) is received from the image forming device 5 is formed in an upper portion of a right side plate (a side plate on the image forming device 5 side) of the casing 11. In an upper part of the left side plate (a side plate on the post-processing device 9 side), a discharge port 23 is formed to exchange paper with the post-processing device 9. The sheet is conveyed by the conveying section 15 and the cooling section 19 along the conveyance direction X extending from the receiving port 21 toward the discharge port 23. An upstream side and a downstream side in the following description respectively indicate an upstream side and a downstream side in a conveyance direction X of the sheet. A direction orthogonal to the conveyance direction X is referred to as a width direction.

Next, the heating section 13 will be described. As shown in FIGS. 3 and 4, the heating section 13 includes a plurality of blower fans 31, a heater unit 33, and a case 35 in which the plurality of blower fans 31 are supported and the heater unit 33 is housed.

The case 35 is formed in a box shape with an open lower side, and has a hollow portion which is long in the conveyance direction and surrounded by an upper plate, front and rear side plates, and left and right side plates. A plurality of (six in this example) exhaust ports (not shown) are formed in the upper plate. An exhaust fans 39 (see FIG. 2) is connected to each exhaust port through a duct 37. By driving the exhaust fans 39, the air in the case 35 is exhausted and the air in the hollow portion of the case 35 is circulated.

A plurality of (12 in this example) blower fans 31 are supported by the upper plate of the case 35. Six blower fans 31 are arranged in each two rows along the conveyance direction X. The intervals between the blower fans 31 adjacent to each other in the conveyance direction X and the width direction are substantially equal to each other. The plurality of blower fans 31 have the same air volume, and take in outside air and blow the taken outside air into the hollow portion of the case 35.

The heater unit 33 includes a plurality (24 in this example) of infrared heaters 41, a plurality of (24 in this example) reflection plates 43, and a housing 45 in which the plurality of heaters 41 and reflection plates 43 are housed.

The housing 45 is formed in a box shape with an open lower side and has a hollow portion which is long in the conveyance direction and is surrounded by the top plate 45*a*, front and rear side plates, and left and right side plates. As shown in FIG. 5, a plurality of through holes 51 are formed in one surface of the top plate 45*a*. The plurality of through holes 51 are arranged in a staggered pattern with equal density. A dimension (diameter) of a through hole 51 formed in a predetermined region A (see FIG. 3) on the downstream side in the heating section 13 (for example, a portion having a length of ¼ along the conveyance direction X of the top plate 45*a*, for example, hereinafter, simply referred to as a downstream region A) is larger than a dimension (diameter) of the through hole 51 formed in other portions. The top plate 45*a* is an example of a rectifying member having a large number of through holes formed therein, and rectifies air taken into the case 35 by the blower fan 31 so as to be directed downward.

As shown in FIG. 4, each heater 41 has, for example, a thin plate-like carbon filament 55 and a glass tube 57 containing the filament 55. The filament 55 emits infrared rays in all directions (360 degrees) in the radial direction. The heaters 41 are arranged at equal intervals along the conveyance direction X in an attitude along the width direction.

The reflection plate 43 has a U-shape opening downward when viewed from the width direction, and has a substantially rectangular upper wall and side walls bent downward at substantially right angles from both long sides of the upper wall. A plurality of through holes 59 are formed in the upper wall. As shown in FIG. 5, a plurality of through holes 59 are arranged in a staggered pattern with equal density. The size (dimension) of the through hole 59 of the reflection plate 43 arranged in the downstream region A (see FIG. 3) is larger than the size (diameter) of the through hole 59 formed in the other portions. The reflection plate 43 is disposed above the heater 41 and reflects the infrared rays emitted from the filament 55 downward.

Next, the conveying section 15 will be described. As shown in FIGS. 3 and 4, the conveying section 15 includes a conveyance belt 61 and a frame 63 for supporting the conveyance belt 61. The frame 63 has front and rear side plates which are arranged at predetermined intervals in the front and rear directions and which are long in the conveyance direction X. A drive roller 65 is rotatably supported between the upstream end portions of the front and rear side plates, and a driven roller 67 is rotatably supported between the downstream end portions.

The conveyance belt 61 is an endless belt, and a large number of through holes (not shown) are formed on the entire surface. The conveyance belt 61 is wound around the drive roller 65 and the driven roller 67. When the drive roller 65 is driven, the conveyance belt 61 circulates and travels in the counterclockwise direction in FIGS. 2 to 4. The outer surface of the conveyance belt 61 along the upper track (the direction from the upstream side to the downstream side) becomes the conveyance surface 61*a* on which the paper is transported. The conveyance belt 61 running on the upper track is supported by conveyance plates 69 supported by the front and rear side plates. A through hole 71 (see FIG. 4) is formed in the entire surface of the conveyance plates 69. When the conveyance belt 61 is traveling, the back surface (the back surface of the conveyance surface 61*a*) of the conveyance belt 61 traveling on the upper track slides along the conveyance plates 69.

As shown in FIGS. 2 and 3, the conveying section 15 is longer than the heating section 13 on the upstream side in the conveyance direction X. More specifically, the upstream end portion of the conveyance surface 61*a* of the conveyance belt 61 extends upstream from the upstream end portion of the heating section 13 and upstream from the receiving port 21. The downstream end of the conveyance surface 61*a* is located at substantially the same position as the downstream end of the heating section 13 and communicates with the cooling section 19.

Next, the suction section 17 will be described. As shown in FIGS. 3 and 4, the suction section 17 is provided in a hollow portion of the conveyance belt 61. The suction section 17 includes a partition plate 83 and a plurality of (three in this example) suction fans 85 supported by the partition plate 83. The partition plate 83 has a bottom plate and partition walls for covering four sides, and the hollow portion is divided into a plurality (three in this example) of sections S1, S2, and S3 along the conveyance direction X, as shown in FIG. 3. The upper surface of each section is open and faces the conveyance plates 69.

The volume of the section S3 on the most downstream side in the conveyance direction X is smaller than the volumes of the other sections S1 and S2. That is, the bottom area of the section S1 on the downstream side in the conveyance direction X is formed to be smaller than the bottom areas of the other sections S2 and S3.

The suction fan 85 is attached to the bottom plate of the partition plate 83 corresponding to each section. The plurality of suction fans 85 have the same air volume. When the suction fan 85 is driven, air in the space above the conveyance belt 61 (conveyance surface 61*a*) running on the upper track are taken into each section through the through hole of the conveyance belt 61 and the through hole 71 of the conveyance plates 69.

An example of a drying operation of the drying device 7 having the above configuration will be described with reference to FIGS. 2 to 5. The paper on which an image has been formed by the image forming device 5 (see FIG. 1) is received by the conveying section 15 through the receiving port 21 of the drying device 7. As described above, since the upstream end portion of the conveyance surface 61*a* of the conveyance belt 61 extends to the upstream side of the receiving port 21, the paper discharged from the image forming device 5 is placed on the conveyance surface 61*a* of the conveyance belt 61.

In the conveying section 15, the drive roller 65 is driven to rotate, and the conveyance belt 61 travels. As a result, the paper loaded on the conveyance surface 61*a* is transported into the casing 11 through the receiving port 21.

Further, the blower fan 31 and the heater unit 33 of the heating section 13 are driven. The air taken into the hollow portion of the case 35 by the blower fan 31 is blown downward. Then, the air enters the housing 45 through a through hole 51 formed in the top plate 45*a* of the housing 45 of the heater unit 33 (see arrow A1 in FIG. 4). In the housing 45, infrared rays are emitted from each heater 41 in all directions by driving the heater unit 33. Infrared rays radiated upward from the heater 41 are reflected downward by the reflection plate 43.

The air entering the housing 45 is blown further downward through the through hole 59 of the reflection plate 43 of the heater unit 33 (see arrow A2 in FIG. 4), and is heated by infrared rays emitted from the heater 41. The air thus heated is blown against the paper being conveyed along the conveyance surface 61*a* of the conveyance belt 61 to dry the ink. Further, the paper is pressed against the conveyance surface 61*a* by the blown wind. Hereinafter, the force with which the sheet is pressed against the conveyance surface 61*a* in the heating section 13 is referred to as a pressing force.

Further, the suction fan 85 of the suction section 17 is driven. As a result, as described above, air in the space above the conveyance belt 61 traveling on the upper track is taken in through each section through the through hole of the conveyance belt 61 and the through hole 71 of the conveyance plates 69 (see arrow A3 in FIG. 4), and a negative pressure is applied above the conveyance surface 61*a*. Then, the sheet conveyed on the conveyance surface 61*a* of the conveyance belt 61 is attracted to the conveyance surface 61*a*. Hereinafter, the force with which the sheet is attracted to the conveyance surface 61*a* by the suction section 17 is referred to as an attracting force.

When the paper is conveyed along the conveyance surface 61*a* from the upstream side to the downstream side, the heating section 13 dries the ink. Here, as described above, in the downstream region A, since the diameter of the through hole 51 formed in the top plate 45*a* of the housing 45 and the diameter of the through hole 59 formed in the reflection plate 43 are larger than the diameters of the other through holes, the amount of air passing through the top plate 45*a* and the reflection plate 43 increases. That is, the amount of warm air blown onto the paper on the conveyance surface 61*a* increases, and the pressing force increases.

Further, the suction section 17 is formed such that the volume of the section S3 on the most downstream side in the conveyance direction X is smaller than the volumes of the other sections S1 and S2. Since the suction fan 85 has the same air volume, the smaller the volume of the section, the larger the attracting force. In this way, the pressing force and the attracting force are increased on the downstream side of the conveyance surface 61*a*.

While the sheet is conveyed on the conveyance surface 61*a*, the inside of the case 35 of the heating section 13 and the inside of the housing 45 of the heater unit 33 are in an environment of high humidity and high temperature, so that the exhaust fans 39 (see FIG. 1) is driven to circulate air.

The sheet conveyed along the conveyance surface 61*a* to the downstream side is conveyed up to the cooling section 19 (see FIG. 1), cooled by the cooling section 19, and then conveyed through the discharge port 23 to the post-processing device 9 (see FIG. 1).

As is clear from the above description, according to the drying device 7 of the present disclosure, the pressing force and the attracting force are increased on the downstream side of the conveyance surface 61*a* where ink drying progresses. As described above, as the drying of the ink advances, in other words, as the ink is conveyed from the upstream side to the downstream side, the paper tends to be curled. Therefore, by increasing the pressing force and the attracting force on the downstream side, it is possible to suppress the floating or moving of the paper from the conveyance surface 61*a* and to prevent curling.

On the other hand, on the upstream side, ink drying does not progress, and a color shift or the like tends to occur. Therefore, it is not preferable that the sheet is strongly attracted to the conveyance surface 61*a*. In the present disclosure, since the pressing force and the attracting force are large only on the downstream side, it is possible to prevent the occurrence of color shift and to prevent curling.

In the above-described embodiment, in the downstream region A, the diameter of the through hole 51 formed in the top plate 45*a* and the diameter of the through hole 59 formed in the reflection plate 43 are made larger than the diameters of the other through holes, so that the pressing force on the downstream side is increased. Accordingly, since the air volume of the plurality of blower fans 31 can be made constant, it is possible to easily select and control the blower fans 31. Note that it is also possible to have the through holes 51 and 59 to have a fixed diameter, and to arrange these through holes 51 and 59 at a higher density on the downstream side than on the upstream side. Further, when the diameters of the through holes 51 and 59 are fixed, the air volume of the blower fans 31 on the most downstream side may be increased.

Further, in the suction section 17, the volume of the downstream section S3 is made smaller than that of the other sections, thereby increasing the attracting force on the downstream side. Accordingly, since the air volume of the plurality of suction fans 85 can be made constant, it is possible to easily select and control the suction fans 85. Note that it is also possible to have the bottom areas of all the sections to be the same and to lower the height of the downstream section S3. Alternatively, the diameter of the through hole 71 of the conveyance plates 69 facing the downstream section S3 may be made smaller than that of the portion facing the other section. Also in these cases, the attracting force on the downstream side can be increased. Further, the volumes of the sections may be the same, and the air volume of the suction fan 85 on the most downstream side may be increased.

Further, in the present embodiment, both the pressing force of the heating section 13 and the attracting force of the suction section 17 are higher on the downstream side than on the upstream side, but either the pressing force of the heating section 13 or the attracting force of the suction section 17 may be higher on the downstream side than on the upstream side.

Further, in the present embodiment, the pressing force of the heating section 13 and the attracting force of the suction section 17 are increased in the downstream portion, but they may be gradually increased from the upstream side toward the downstream side.

Although the present disclosure has been described respect to certain embodiments, the disclosure is not limited to the embodiments described above. The above embodiments may be variously modified, substituted, or modified as long as they do not depart from the scope and spirit of the disclosure, and the claims include all embodiments that may fall within the scope of the technical ideas.

What is claimed is:

1. A drying device that dries a medium on which an image is formed while conveying the medium, comprising:

a conveyance belt having through holes formed in an entire surface thereof for supporting the medium and conveying the medium in a predetermined conveyance direction;

a heating section that blows warm air onto the medium to dry the image and presses the medium against the conveyance belt by the warm air; and a suction section that attracts the medium to the conveyance belt by sucking air through the through holes, wherein the heating section including:

a blower fan that takes in outside air and blows the taken outside air toward the conveyance belt;

a rectifying member that is arranged on a downstream side of the blower fan in a blowing direction of the blower fan and in which a large number of through holes are formed;

a heater that is arranged on a downstream side of the rectifying member in the blowing direction; and a reflection plate provided between the rectifying member and the heater, for reflecting infrared rays emitted from the heater towards the conveyance belt, the reflection plate having a U-shape opening downward and having a large number of through holes formed therein, at least one of a force with which the heating section presses the medium against the conveyance belt and a force with which the suction section attracts the medium to the conveyance belt is greater on a downstream side in the conveyance direction than on an upstream side in the conveyance direction.

2. The drying device according to claim 1, wherein dimensions of the large number of through holes formed in the rectifying member are larger on the downstream side than on the upstream side in the conveyance direction.

3. The drying device according to claim 1, wherein dimensions of the large number of through holes formed in the reflection plate are larger on the downstream side than on the upstream side in the conveyance direction.

4. The drying device according to claim 1, the suction section including:

a plurality of sections divided along the conveyance direction; and suction fans each having a same air volume for sucking the plurality of sections, respectively, wherein a volume of the plurality of divided sections is smaller on the downstream side in the conveyance direction than on the upstream side in the conveyance direction.

5. An image forming system comprising:

an image forming unit that forms an image on a medium; and a drying unit that dries the medium on which the image is formed while conveying the medium;

wherein the drying unit includes:

a conveyance belt having through holes formed in an entire surface thereof for supporting the medium and conveying the medium in a predetermined conveyance direction; and a heating section that blows warm air onto the medium to dry the image and presses the medium against the conveyance belt by the warm air; and a suction section for attracting the medium to the conveyance belt by sucking air through the through hole, and wherein the heating section including:

a blower fan that takes in outside air and blows the taken outside air toward the conveyance belt;

a rectifying member that is arranged on a downstream side of the blower fan in a blowing direction of the blower fan and in which a large number of through holes are formed:

a heater that is arranged on a downstream side of the rectifying member in the blowing direction; and a reflection plate provided between the rectifying member and the heater, for reflecting infrared rays emitted from the heater towards the conveyance belt, the reflection plate having a U-shape opening downward and having a large number of through holes formed therein, and at least one of a force with which the heating section presses the medium against the conveyance belt and a force with which the suction section attracts the medium to the conveyance belt is greater on a downstream side in the conveyance direction than on an upstream side in the conveyance direction.

6. A drying device that dries a medium on which an image is formed while conveying the medium, comprising:

a conveyance belt having through holes formed in an entire surface thereof for supporting the medium and conveying the medium in a predetermined conveyance direction;

a heating section that blows warm air onto the medium to dry the image; and a suction section that sucks air through the through holes formed in the entire surface of the conveyance belt, to attract the medium to the conveyance belt, wherein the heating section and the suction section are arranged such that at least one of the warm air that the heating section blows and the air that the suction section sucks presses the medium against or attracts the medium to the conveyance belt at different forces between on a downstream side of the conveyance belt in the conveyance direction and on an upstream side of the conveyance belt in the conveyance direction, the force on the downstream side being greater than the force on the upstream side.

* * * * *